US005327617A

United States Patent [19]

Yao

[11] Patent Number: 5,327,617

[45] Date of Patent: Jul. 12, 1994

[54] ELECTROSTATIC OPENING AND SHORT FIBER SEPARATION APPARATUS FOR CARDING MACHINES

[75] Inventor: S. C. Yao, Taipei, Taiwan

[73] Assignee: China Textile T&R Institute, Taipei, Taiwan

[21] Appl. No.: 49,499

[22] Filed: Apr. 21, 1993

[51] Int. Cl.[5] ..... D01G 1/00; B03B 7/00

[52] U.S. Cl. ..... 19/98; 209/12.1; 209/129; 19/200

[58] Field of Search ..... 209/12, 127.1, 128, 209/129, 131; 19/98, 200, 106 R

[56] References Cited

U.S. PATENT DOCUMENTS

| | | | |
|---|---|---|---|
| 2,328,577 | 9/1943 | Oglesby | 209/129 X |
| 3,341,007 | 9/1967 | Mayer, Jr. et al. | 209/127.1 X |
| 3,341,008 | 9/1967 | Mayer, Jr. et al. | 209/127.1 X |
| 3,346,110 | 10/1967 | LaFranca, Jr. et al. | 209/127.1 X |
| 3,349,902 | 10/1967 | LaFranca, Jr. et al. | 209/127.1 X |
| 4,827,574 | 5/1989 | Nakano et al. | 19/98 X |

*Primary Examiner*—Clifford D. Crowder
*Assistant Examiner*—John J. Calvert
*Attorney, Agent, or Firm*—Morton J. Rosenberg; David I. Klein

[57] ABSTRACT

An electrostatic opening and short fiber separation apparatus for carding machines making use of a high voltage electrostatic field; which produces different forces on filaments, short fibers, and dust; in cooperation with a plurality of suction devices to separate short fiber. The apparatus is to be installed in front of a card cylinder where a doffer and a sliver forming mechanism have been removed. By means of a specially designed stripping roller, fibers are stripped from the cylinder and float across the electric field due to the attraction of suction devices. Cotton fibers in the electric field will be affected by the high voltage and held by upper and lower circular metal screen conveyor belts, to move forward. Short fibers and dust move to and fro between two metal strips due to the existence of the electric field; they will be taken up and removed if the drag force of suction devices is larger than the action force of the electric field. By this way, long staple will be sent to the cage roller in front to form webs and then formed into sliver. Most sizes of short fibers removable in the apparatus are under half an inch and therefore can effectively control the short fiber content, promote fiber parallelization, and assure the fiber quality.

1 Claim, 2 Drawing Sheets

ELECTROSTATIC OPENING AND SHORT FIBER SEPARATION APPARATUS FOR CARDING MACHINES

BACKGROUND OF THE INVENTION

The removal of short fibers is generally done by combers, which influences the quality of cotton yarn very much. Removal amount, usually ranging from 15% to 25%, greatly depends on the desired quality grade of cotton yarn and raw material. Because of the limitation of the design of combers, slivers must be prepared by drawing and lapping. Damage to fibers may result during the removal of short fibers, and so this method is not justified from an economic view point.

Although there exist on the market nowadays short fiber separation apparatuses employing a high voltage electrostatic field, their performance has not reached a high level. The invention makes use of a high voltage electrostatic field accompanying with suction devices to promote the removal rate of short fibers, attaining a very remarkable effect.

The features, advantages, and minute arrangement of the invention will be apparent from the following detailed description when read in conjunction with the accompanying drawings

DETAILED DESCRIPTION

Figure 1:
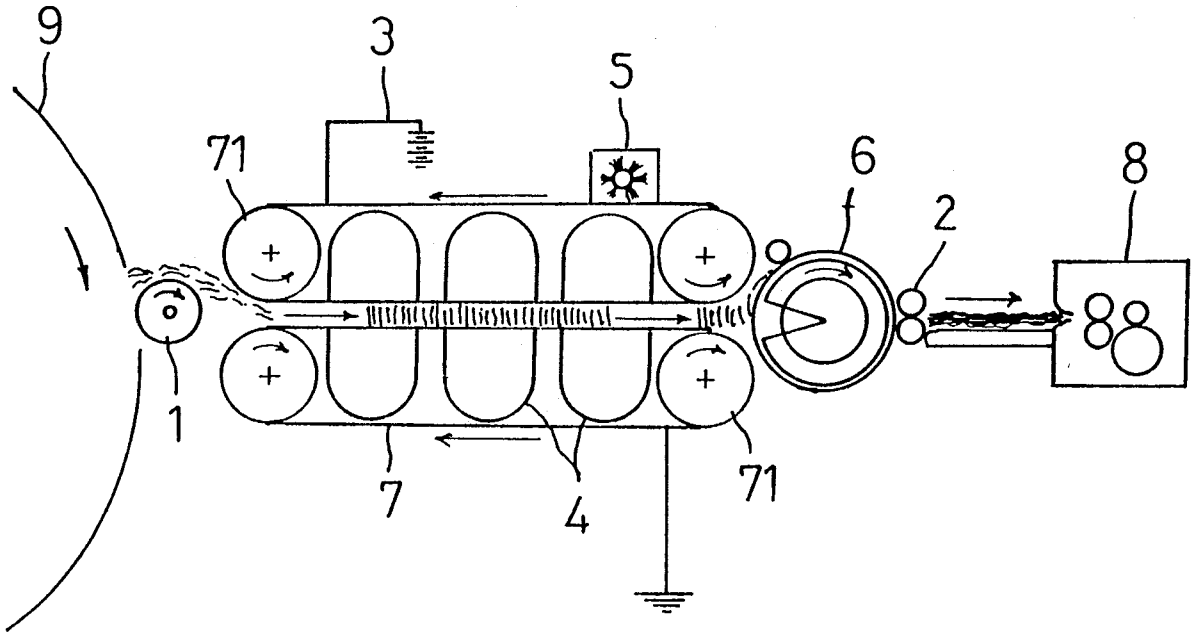
FIG. 1 is a schematic view of an embodiment of the invention.

Referring to FIG. 1, there is shown, a stripping roll (1) replacing the doffer of the carding machine. The stripping roll is located at a position above the cylinder (9) adjoining the doffer's former position. The stripping roll is enveloped by metallic cloth and has the same rotation direction as the cylinder (9). Along with the adjustment in spacing and speed, and under the condition that fibers not be harmed; the web on the cylinder (9) is fed into a zone between two metal screen strips (7). The metal screen strips (7) have orifices evenly distributed on the surfaces and are driven by the longitudinally displaced driving rollers (71). Inside the metal screen strips are disposed at least three suction devices in spaced relationship between the drive rollers (11) and a high potential difference is imposed between the metal screen strips so that as is fed by the stripping roller (1), the fibers will be drawn and parallelized by the action of the electric field. Because the electric field has less effect on short fibers and tiny dust particles, they float up and down, and move slowly. When the action force of the electric field is less than the drawing force of suction devices, short fibers and tiny dust will be drawn into a dust collector by the suction devices (4) inside metal screen strips; however, long filaments will be driven by the electric field to pass through suction zones in a direction perpendicular to the space between upper and lower metal screen strips (7) and then taken up by cage rollers (6) to form webs, which are stripped off by two press rollers (2) and fed into the sliver forming mechanism (8) to form slivers. A cleaning brush (5) may be provided outside the metal screen strips (7) to cleanse metal screen strips (7).

Through the arrangement of the invention, it can acquire the advantages as follows.

(1) Promoting the removal proportion of short fibers.

Figure 3:
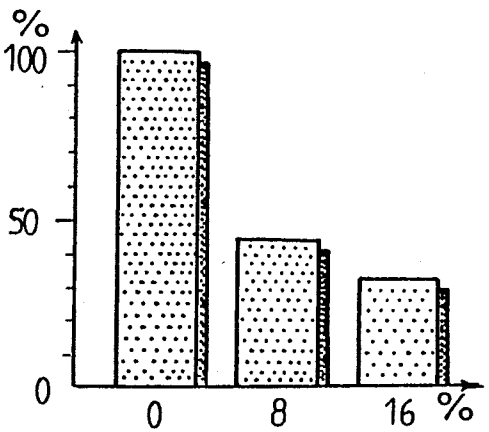
Figure 2:
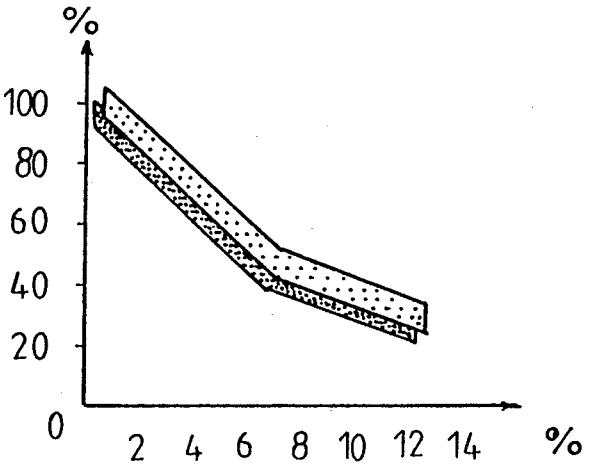
FIG. 2 is a graph of combing noilage versus the reduction ratio of sliver dust; and, FIG. 3 is a comparison graph of combing noilage versus broken yarn reduction.

The removal of short fibers has much influence on the quality of cotton yarn. Fiber fly during twisting, IPI readings, and strength will be affected by the short fiber content. Generally the removal of short fibers is done by a comber. The quality of combed yarn rises as the removal amount increases until the removal proportion reaches 8%, above which the tendency of rising will gradually become flattened as shown in FIG. 2. Besides, the removal proportion has also a similar effect on broken yarn as can be seen from FIG. 3. With the invention arrangement, a single removal zone can remove short fibers up to 4.5%. To heighten the removal amount of short fibers, the invention triples the removal zone so that the path passing through the electrostatic field lengthens. On the other hand, an intermittent charging and discharging operation (lasting 0 to 20 seconds) is imposed on the electrostatic field between the metal screen strips to drag moving fibers therein and so fiber groups are irregularly stretched by the electrostatic force, altering fiber bridging to allow short fibers emerging from groups to be taken up by the suction devices inside metal screen strips, as a consequence of which the removal proportion may be increased to 8%. And thus it can attain a practical efficiency.

(2) Enhancing the short fiber content of separated short fibers.

The short fibers separated by the invention, analyzed by AFIS for fiber length, contains short fibers up to 81% by number, which is superior to the 72% of a conventional electrostatic short fiber separation apparatus.

(3) Removing dust and tiny foreign matter.

During spinning, dust may cause dirty deposits on rotors. The slivers made by the apparatus according to the invention almost have been cleared of dust and tiny foreign matter, which greatly benefits the spinning of open-end yarn.

(4) No hooks in the slivers made by the invention.

Due to the action of the electrostatic field, fibers are uprightly drawn and conglomerated to form a web. The produced slivers present an even, parallel, and unhooked fiber constitution. Hence, the first drawing of the post-drawing process may be omitted.

(5) Shortening the process and reducing costs.

In a prior art spinning process, to remove short fibers, cotton must be prepared by drawing and lapping before going through combing, which is not an ideal method from an economic viewpoint. The invention can shorten the spinning process as well as save great cost in personnel, utilities, and equipment.

What is claimed is:

1. An electrostatic short fiber separation system for use with a carding machine, comprising:

a stripping roller having a metallic cloth covering and being positioned on one side of a card cylinder of said carding machine, said stripping roller being rotatively driven in a direction coinciding with said card cylinder for removing a web of fibers therefrom, said stripping roller being provided in substitution of a doffer of said carding machine;

conveyor means extending longitudinally from said stripping roller for transport of said web of fibers therefrom, said conveyor means including:

a. a pair of perforate metal screen strips disposed in spaced parallel relation, each of said perforate metal screen strips being drivingly coupled between a respective pair of longitudinally displaced rollers;

b. high voltage means for establishing an electrostatic field between said pair of perforate metal screen strips, said electrostatic field causing long fibers to bridge between said spaced perforate metal screen strips; and, c. at least three short fiber removal zones disposed in longitudinally spaced relation between each of said pairs of longitudinally displaced rollers, the removal zones including a suction source applying a greater force on the short fibers and dust than a force applied thereto by said electrostatic field for removing short fibers and dust from said web of fibers through each of said perforate metal screen strips;

cage roller means disposed at a distal end of said conveyor means for forming a web of long fibers therefrom; and, means for forming sliver from said web of long fibers disposed adjacent said cage roller means, the silver forming means including a pair of press rollers for stripping said web of long fibers from said cage roller means.

* * * * *